US005992677A

United States Patent [19]

Ebine

[11] Patent Number: 5,992,677

[45] Date of Patent: Nov. 30, 1999

[54] DUAL COMPARTMENT BEVERAGE CONTAINER

[76] Inventor: Akemi Ebine, 1958-12 Ohtuka Cho, Mito-shi, Ibaragi 311-41, Japan

[21] Appl. No.: 08/570,894

[22] Filed: Dec. 12, 1995

[51] Int. Cl.[6] ..... B65D 25/04

[52] U.S. Cl. ..... 220/505; 220/524; 220/906; 220/711; 220/789

[58] Field of Search ..... 220/269, 270, 220/254, 255, 521, 523, 524, 906, 505, 527, 553, 260, 265, 266, 268, 272, 273, 307, 711, DIG. 19, 781, 789

[56] References Cited

U.S. PATENT DOCUMENTS

| | | | |
|---|---|---|---|
| 603,316 | 5/1898 | Bush . | |
| 1,255,772 | 2/1918 | Miller . | |
| 1,466,593 | 8/1923 | Kirchmer, Jr. . | |
| 1,523,297 | 1/1925 | Savery . | |
| 1,577,969 | 3/1926 | Hickingbotham | 220/524 |
| 1,686,200 | 10/1928 | Cannard et al. . | |
| 2,080,090 | 5/1937 | Mumaugh | 220/906 |
| 2,096,825 | 10/1937 | Roman | 206/47 |
| 2,197,449 | 4/1940 | Conill | 220/9 |
| 2,331,675 | 10/1943 | Frost | 242/55.5 |
| 2,460,765 | 2/1949 | Palaith | 62/92 |
| 3,169,679 | 2/1965 | Hunter | 222/484 |
| 3,217,949 | 11/1965 | Davis | 222/480 |
| 3,305,368 | 2/1967 | Bourelle | 220/521 |
| 3,459,295 | 8/1969 | Cousar | 206/47 |
| 3,732,999 | 5/1973 | Rounkles | 215/6 |
| 3,920,120 | 11/1975 | Shveda | 206/217 |
| 4,576,306 | 3/1986 | Kelsey et al. | 220/271 |
| 4,584,848 | 4/1986 | Barnett | 62/294 |
| 4,651,890 | 3/1987 | Coker et al. | 220/85 R |
| 4,784,678 | 11/1988 | Rudick et al. | 62/4 |
| 4,817,815 | 4/1989 | Stahlecker | 220/209 |
| 4,911,320 | 3/1990 | Howes | 220/20 |
| 5,056,659 | 10/1991 | Howes et al. | 206/217 |
| 5,056,681 | 10/1991 | Howes | 220/906 |
| 5,290,574 | 3/1994 | Jamieson et al. | 220/521 |
| 5,316,398 | 5/1994 | Chandaria et al. | 401/18 |
| 5,335,813 | 8/1994 | Qi | 220/524 |
| 5,427,258 | 6/1995 | Krishnakumar | 215/400 |
| 5,439,103 | 8/1995 | Howes | 206/217 |
| 5,492,244 | 2/1996 | Kim | 220/524 |

*Primary Examiner*—Stephen Castellano
*Attorney, Agent, or Firm*—Vance, Romero & Montague, P.S.

[57] ABSTRACT

Apparatus and methods for providing an improved container for holding a liquid and the manufacture thereof. The apparatus generally comprising at least two compartments wherein a first compartment may contain a readily dispensable liquid and a second compartment may contain a removable product, article, prize, or object.

6 Claims, 3 Drawing Sheets

DUAL COMPARTMENT BEVERAGE CONTAINER

COPYRIGHT NOTICE

© Copyright 1995, James R. Vance. All Rights Reserved.

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

TECHNICAL FIELD

This invention relates to containers for holding beverages under pressure and to the manufacture thereof. More particularly, this invention relates primarily to beverage cans used to hold carbonized or carbonated soda drinks and/or fermented beverages under pressure and to the manufacture thereof.

BACKGROUND ART

The following is a brief introduction to the history of the soda beverage industry and some of the inherent problems with current beverage packaging. Thereafter, the present invention will be explained.

Carbonized or carbonated soda drink beverages are so commonplace and readily available throughout the world, it can be hard to understand that at one time such products were nonexistent. It is believed that initial efforts to replicate nature's bubbling mineral water began approximately four centuries ago. However, such efforts were without significant success.

In 1772 an Englishman by the name of Mr. Joseph Priestley succeeded in replicating natural bubbling mineral water. Within a few years bottling companies began offering "soda water" to the public.

In 1825 Mr. Elias Durand of Philadelphia, Pa., installed one of the first soda fountains in an American pharmacy named the Baghdad drugstore. Needless to say, the soda fountain revolutionized the American drugstore industry creating a meeting place for young and old patrons and creating a whole new source of income for the proprietors of such establishments. The acceptance of such beverages created a natural demand for more popular and tastier flavors.

In about 1850, the first flavor to revolutionize the soft-drink market was invented in Ireland by Dr. Cantrall. That flavor was known as ginger ale and was soon being shipped to the United States of America in bottles.

In 1885 a beverage chemist by the name of Mr. R. S. azenby began selling a beverage under the trademark DR EPPER at a number of local soda fountains in Waco, Tex.

In 1886 a renowned pharmacist by the name of Mr. John S. Pemberton concocted an elixir for the aid of the nervous and those inclined to over imbibe and sold the mixture at local soda fountains in Atlanta, Ga. The product was so well received by the public that the product was soon widely distributed under the trademark COCA-COLA.

In 1889 another pharmacist by the name of Mr. Caleb Bradham invented a recipe for a product later to be sold under the trademark PEPSI-COLA.

The success of these new beverages is undisputable. By 1929, sixty percent (60%) of America's 58,258 drugstores had installed a soda fountain.

However, by the 1970's, the number of soda fountains found in drug stores had dropped to less than one-third of the soda fountains in operation in 1929. It is believed that the demise of the drugstore soda fountain industry is primarily attributed to increased acceptance and availability of bottled and canned soda beverages.

It is very important to note, however, how entrenched the soda industry has become. The same products that were introduced in 1772, 1825, 1850, 1885, 1886, and 1889 appear to remain some of the most dominant products in the soda marketplace. Even though twentieth century bottling and canning machinery has been adopted, in order to keep up with the continued high demand for these products, in general, very little progress has been made in the soda beverage industry. This is particularly true with respect to beverage containers.

For example, since the late 1700's, carbonized or carbonated soda beverages were almost exclusively stored within thick-walled glass bottles or were freshly prepared. In 1935 Americans were first introduced to beverages contained in cans. Such cans, however, were very heavy and bulky. Pull-top cans were first introduced to consumers in the United States of America in the mid-1960's. Soda drinks can also now be purchased within plastic bottles.

To a very large extent packaging for fermented products such as beers and ales have been limited to the type of packaging commonly available. While such beverages were initially stored in large wooden vats or barrels, to assist in the fermentation process, these products were later contained in corked, thick-walled bottles, and more recently within aluminum cans.

With the increased efficiency and availability of intrastate, interstate, and international transportation, large volumes of canned beverages are shipped almost daily. Transportation, often over extended distances over land and/or sea, can occur via air, rail and/or truck.

Furthermore, such products are commonly stockpiled at the packaging plant to fill order and shipping containers. The products are stored during transport. Ultimately, the products are placed upon display for purchase by consumers. Throughout such transportation and storage procedures it is very common for the outer surfaces of the beverage container to become soiled and dirty with dirt, dust, mud, salt, insecticide, pesticide, and/or insect or rodent droppings. These contaminants could present a health hazard to consumers unless they are removed from the exterior surfaces of the beverage containers.

One explanation for the excessive success for such beverages within our modern society is their ready availability at remote locations from our homes in order to quench our thirst. These beverages fit very nicely within our "fast food" culture. However, their purchase often occurs at remote locations where cleanliness might not be available.

Heretofore, it was highly unlikely that either the container or the consumer could or would be properly cleaned prior to consumption of the beverage. Not only was there a danger that the consumer will ingest the aforementioned contaminants, but may also ingest bacteria, germs, and/or dangerous viruses picked up on the consumer's hands and/or face.

The inventor believes that the above-listed devices taken alone or in combination neither anticipate nor render obvious the present invention. These citations do not constitute an admission that such disclosures are relevant or material to the present Claims. Rather, these citations relate only to the general field of the disclosure and are cited as constituting the closest art of which the inventor is aware.

DISCLOSURE OF INVENTION

The present invention comprises an improved container or holding a liquid and the manufacture thereof. More particularly, the present invention comprises an improved container having at least two compartments therein. As used herein, a compartment is a synonym for housing.

A first compartment defines a first enclosure which may hold and contain a readily dispensable liquid. The first compartment has a liquid dispensing opening which may be selectively opened to permit access to the liquid contained within the first enclosure.

A second compartment defines a second enclosure which may hold and contain a removable product, article, prize, or object. The second compartment is positioned internally within the first compartment. The second compartment has an opening which selectively permits access to the second enclosure.

It is important to note that the second enclosure does not directly communicate with the first enclosure. Consequently, products, articles, prizes, and/or objects stored within the second compartment will not become moistened or soiled by coming in contact with the liquid stored within the first compartment. Similarly, the liquid stored within the first compartment will not become soiled or contaminated by coming into contact with the products, articles, prizes, and/or objects stored within the second compartment.

The preferred and alternative apparatus or structures of the present invention and the processes for manufacture thereof will be further described in greater detail in the following sections of this Specification. However, to avoid any possible confusion as to the scope of the present invention, each of the following sections of this Specification in their entirety is incorporated herein by this reference.

It is preferred that the present invention contains carbonized or carbonated soda drinks and/or noncarbonated drinks. However, the present invention may also be used to contain fermented beverages, such as beer or ale, and other alcoholic and/or nonalcoholic beverages. It is further anticipated that many of these beverages, when thus contained, will be under a pressure exceeding one Atmosphere (1 atm).

Of course, if the need arises, the present invention may also be used to contain other liquids without elevated pressurization. For example, liquids such as motor oil, petroleum products, hydraulic fluid, brake fluid, paints, lacquers, thinners, stains, oils, varnishes, liquid soaps, stripping compounds, and the like could be contained within the apparatus of the present invention.

The second compartment could be used to house means for washing or wiping the exterior surfaces of the container and/or the hands and face of the consumer prior to consumption of the beverage. For example, the washing or wiping means may comprise one or more moistened towelettes or washcloths. This enables consumers who do not have ready access to washing facilities the ability to clean the container and themselves prior to consuming the beverage.

Alternatively, the second compartment could be used to house a toy, card, flag, ring, pendant, prize or prize notification, coupon, promotional literature, and/or some other product, article, or object. For example, toys depicting characters of currently distributed or soon to be distributed motion pictures can be inserted into the second compartment thus promoting such movies. Baseball, basketball, football, hockey, and/or other sports cards, flags, rings, pendants, etc., could be inserted into the second compartment thus promoting individual players, teams, leagues, and/or competitions. Similarly, game cards can be inserted into the second compartment to promote either a game and/or a contest within which the consumer may participate. Furthermore, the second compartment may contain a prize or prize notification to the lucky consumer that purchased that particular container. The second compartment could also or alternatively contain one or more coupons and/or other promotional literature to entice the consumer to purchase the promoted goods.

The present invention is easily constructed, and inexpensive and economical to manufacture. Once manufactured, the present invention would not require an alteration of traditional packaging, shipping, handling or display procedures as currently used within the beverage industry.

The present invention is compact, efficient, reliable, durable, and rugged.

It is preferable that the second enclosure communicate with an atmosphere exterior to the apparatus without necessarily requiring the opening of the liquid dispensing opening.

Since the second compartment is positioned internally within the first compartment and the second compartment communicates with the exterior atmosphere without breaking the seal to the beverage contained within the first compartment, additional space is available for thermal expansion of the liquid beverage inwardly in addition to outwardly. This additional expansion space reduces the likelihood of container breakage if the beverage product was allowed to freeze. Consequently, the design of the present invention is believed to be more durable and rugged than the containers that were heretofore available within the beverage industry.

Since the second compartment is positioned internally within the first compartment and the second compartment communicates with the exterior atmosphere without breaking the seal to the beverage contained within the first compartment, the liquid beverage contained within the first compartment can be chilled more quickly than would otherwise be possible. This enhanced chilling ability is primarily due to the increased surface area to which the liquid beverage is exposed and the fact that the additional surface area contributed by the sidewalls of the second compartment is generally located near the center of the contained liquid everage.

This feature of being able to rapidly chill the liquid beverage would be very important to retail store owners because it enables the store to more effectively utilize its refrigeration space. No longer will store owners need to purchase, house, operate, and repair large banks of refrigeration units in order to meet peak demand for chilled beverages. Since the time required to chill the contained beverage is decreased, quickly emptied refrigerator shelf space can be filled with beverage containers at room temperature for quick chilling and still meet the consumer demand for chilled beverages.

The present invention can be used to quickly, efficiency, and easily distribute other products and/or promotional materials through the distribution channels of the beverage industry without incurring additional distribution expenses. In fact, revenues derived from including the aforementioned promotional materials within the second compartment may significantly defray or compensate some of the otherwise necessary distribution expenses. Thus, use of the present invention may create an additional source of revenue for the beverage manufacturer and distributor. The present invention also creates an additional avenue for manufacturers and promoters to market their products and/or services, and literally get their advertisements into the hands of potential customers.

The secondary product, article, prize, or object is generally stored within the second compartment. In turn, the second compartment is positioned internally within the first compartment. Consequently, the exterior surfaces of the beverage container are still available for printing of trademarks, packaging indicia, and required labeling, without any adverse obstruction by the second compartment or product, article, prize, or object contained therein.

The present invention requires minimal manipulation by the consumer and is extremely simple and easy to use.

Since the second compartment is positioned internally within first compartment and is integral with the first compartment, both compartments remain intact even after the container is opened and their contents removed. Consequently, the first compartment and the second compartment are disposed of jointly and do not require additional effort on the part of the consumer in order to recycle the container or properly dispose of the container. Furthermore, since the first compartment and the second compartment are preferably manufactured from coated aluminum, both of these elements may be recycled without significant adverse effect upon the environment.

As stated above, the present invention also comprises the processes used to manufacture such improved beverage containers.

In addition to the foregoing advantages, and other advantages that will be described further below, the present invention also overcomes all of the previously mentioned disadvantages.

These and other objectives and advantages of the present invention will become more readily apparent upon reading the following disclosure and referring to the attached drawings.

BRIEF DESCRIPTION OF DRAWINGS

FIG. 4 also illustrates the placement and removal of an optional container having a lid thereto which contains an expandable, moistened towelette from the second enclosure.

Figure 1:
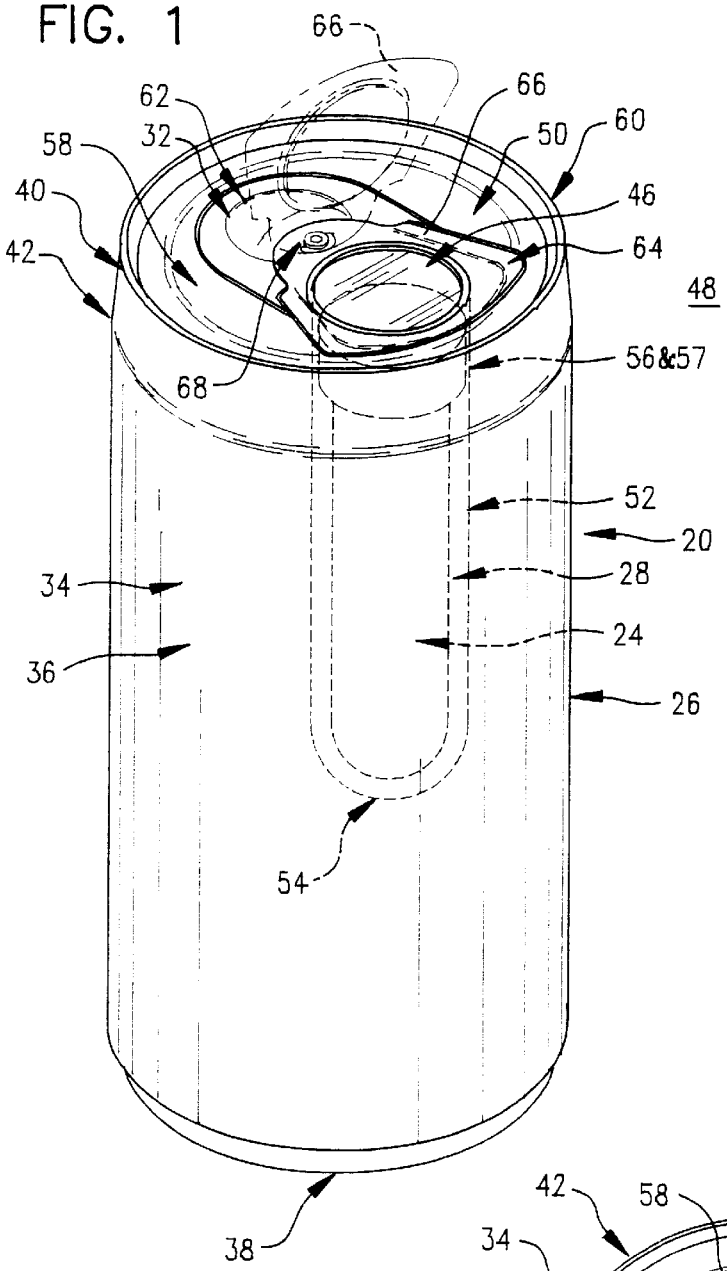
FIG. 1 is an isometric view of a preferred embodiment of the present invention illustrating the location of the interiorly located second compartment in dotted lines and the movement of the pull tab in phantom lines.
Figure 2:
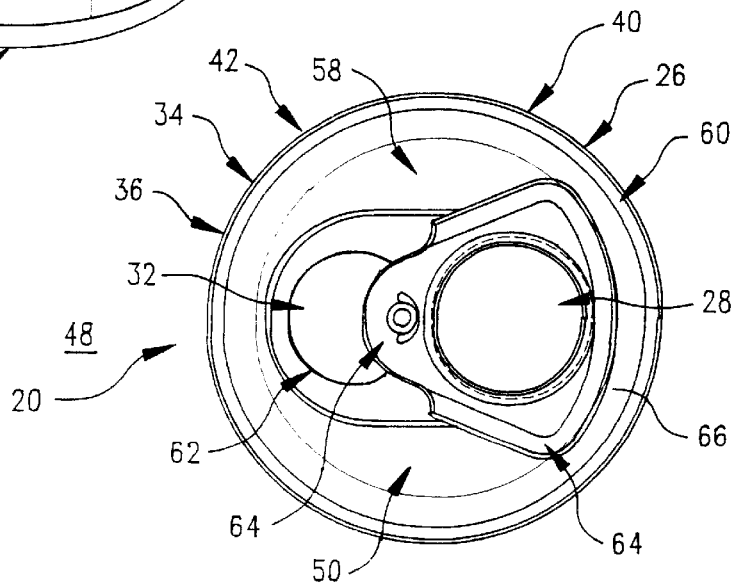
FIG. 2 is a plan view of the apparatus illustrated in FIG. 1 with the first compartment being joined to the second compartment, and the pull tab being joined to the lid or second compartment. The pull tab is illustrated in a position that at least partially obstructs the opening to the second enclosure and prevents the escape of the removable product, article, prize, or object therefrom.
Figure 4:
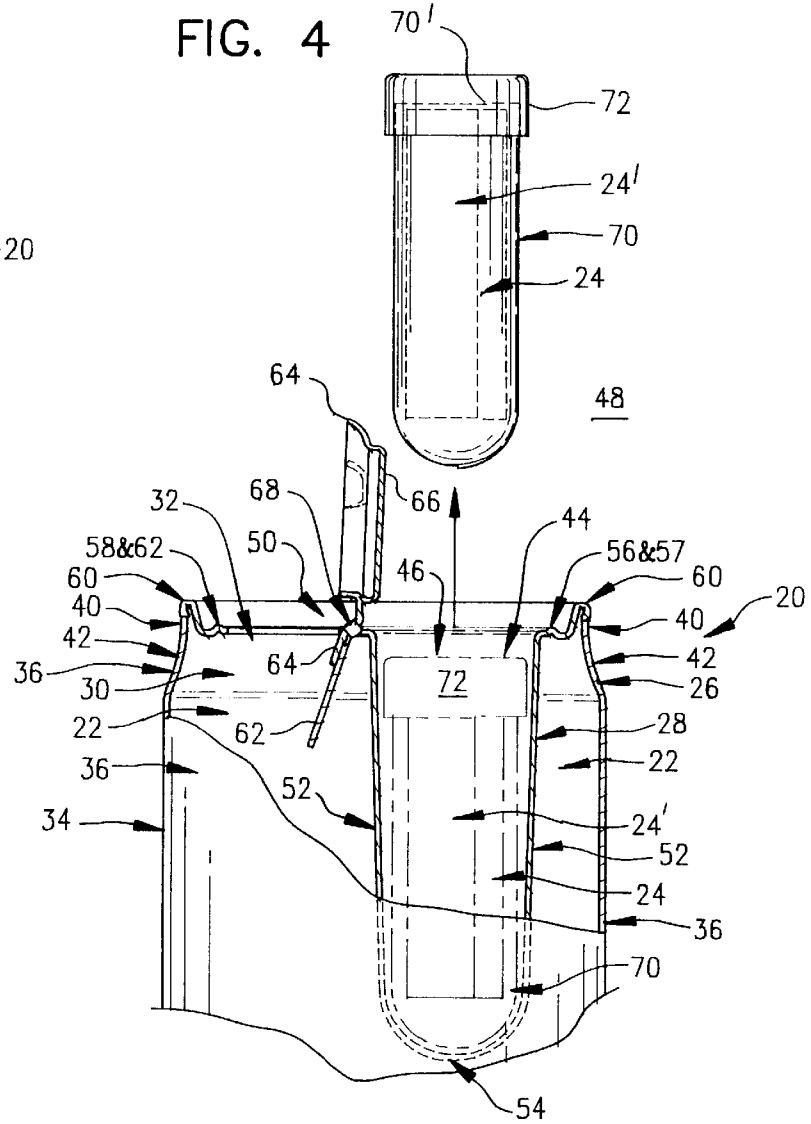
FIG. 4 is a partial, cross-sectional, side-elevational view of the apparatus illustrated in FIGS. 1, 2, and 3, further illustrating the pull tab having ruptured or broken the seal that defines the liquid dispensing opening to permit access to the first enclosure.
Figure 3:
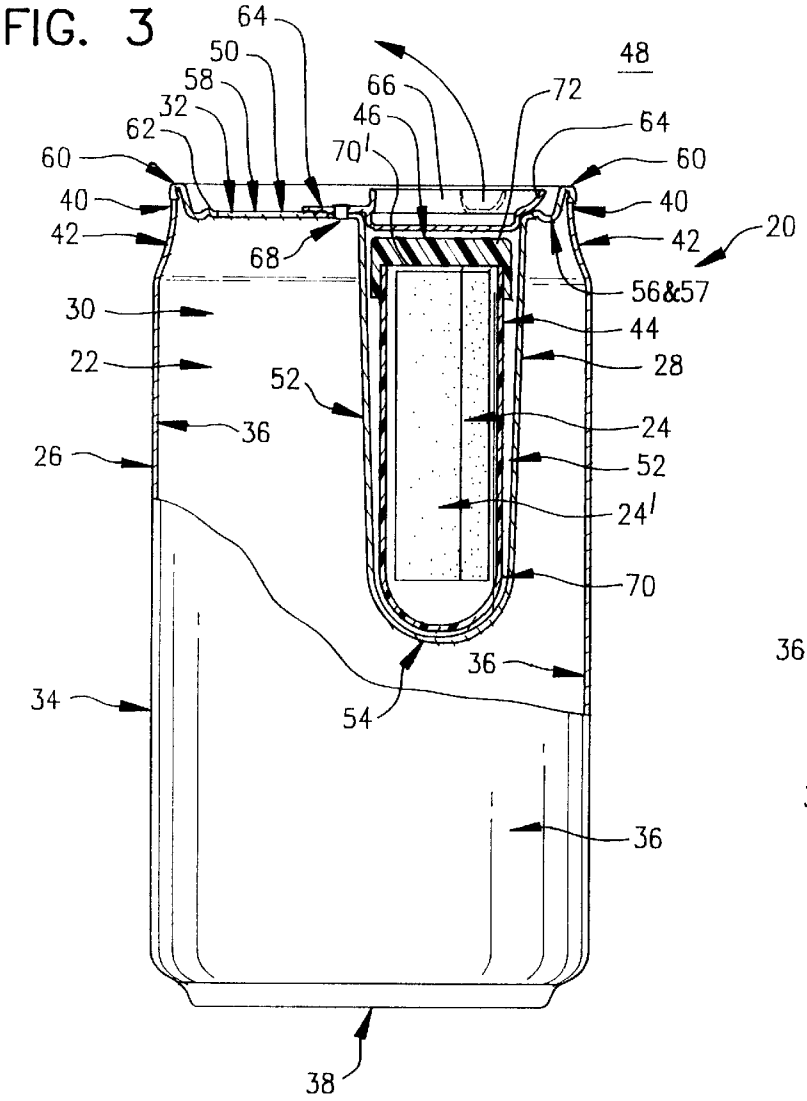
FIG. 3 is a partially-sectioned, cross-sectional, side-elevational view of the apparatus illustrated in FIGS. 1 and 2.
Figure 5:
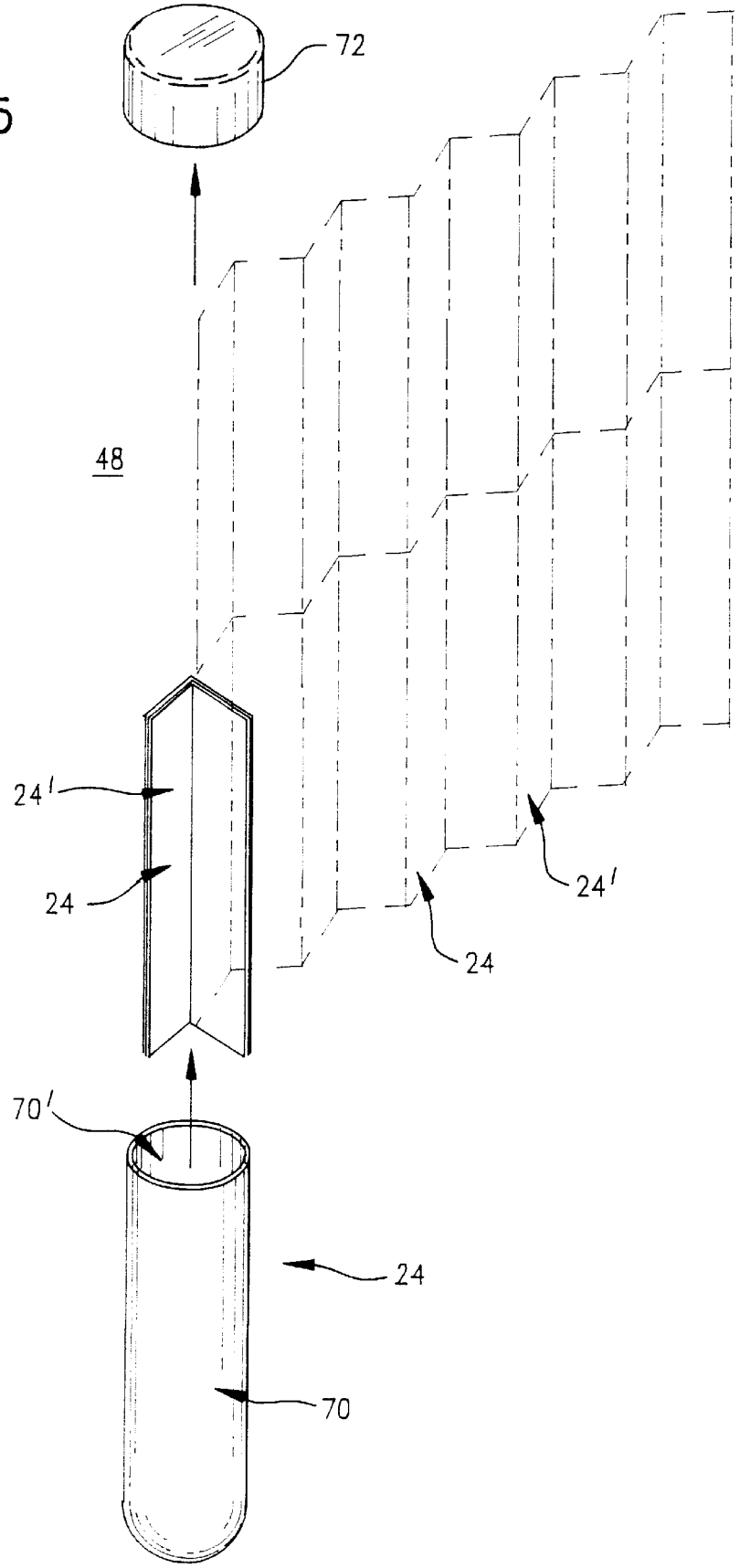
FIG. 5 is a partially exploded, isometric view of a moistened towelette as illustrated in FIGS. 3 and 4, further illustrating the enclosure of the towelette within an optional container having a lid thereto and the expandability of the towelette during use.

One should understand that the drawings are not necessarily to scale and the elements are sometimes illustrated by graphic symbols, phantom lines, diagrammatic representations, and fragmentary views. In certain instances, the inventor may have omitted details which are not necessary for an understanding of the present invention or which render other details difficult to perceive.

BEST MODE FOR CARRYING OUT THE INVENTION

Referring to the drawings, wherein like numerals indicate like parts, the present invention generally comprises an apparatus 20 for containing a liquid 22 and a product, article, prize, or object 24.

Liquid 22 may take many forms. It is the preference of the inventor that liquid 22 be a carbonized soda drink, a carbonated soda drink, a fermented beverage, and the like. However, liquid 22 may also comprise noncarbonated drinks, motor oil, petroleum products, hydraulic fluid, brake fluid, paints, lacquers, thinners, stains, oils, varnishes, liquid soaps, stripping compounds, and the like.

Liquid 22 may be contained within apparatus 20 at a pressure exceeding one Atmosphere (1 atm) or at a pressure of approximately or about one Atmosphere (1 atm).

Within the preferred embodiment of the present invention, product, article, prize, or object 24 comprises a towelette 24'.

To achieve the aforementioned general and specific objectives, apparatus 20 generally comprises a first compartment 26 and a second compartment 28. First compartment 26 defines a first enclosure 30 within which liquid 22 may be contained or dispensed.

Within the preferred embodiment of the invention, first compartment 26 very closely resembles a conventional soda can, similar to those having a rotatable pop-up tab that can be rotated and pulled upwardly to break a seal on an opening to access the carbonized soda drink contained therein. Similarly, first compartment 26 has an openable liquid dispensing opening 32 which selectively permits access to first enclosure 30.

Within the preferred embodiment of the present invention, first compartment 26 is formed by pressing a thin sheet of aluminum to form a thin walled container 34. Container 34 has a generally tubular first sidewall 36 and a first floor 38. First floor 38 is formed integrally with first sidewall 36. First sidewall 36 has a first upper edge 40 positioned at an opposed end 42 from first floor 38.

Although first compartment 26 may take nearly any desirable shape or configuration and still accomplish the purposes of this invention, the inventor prefers that first sidewall 36 be generally cylindrical. However, any tubular shape, albeit having a round, square, triangular, oval, or other cross-sectional appearance, may be similarly be used within the present invention.

Second compartment 28 defines a second enclosure 44 within which the product, article, prize, or object 24 may be removably contained. When properly joined, second compartment 28 is positioned internally within first compartment 26. In fact, second compartment 28 partially defines the upper reaches or boundaries of first compartment 26.

The product, article, prize, or object 24 contained within second compartment 28 can be removed therefrom without becoming soiled by liquid 22 contained within first compartment 26. To accomplish this task, second compartment 28 preferably has an opening 46 thereto that is separate from and not in direct communication with liquid dispensing opening 32 of first compartment 26. In other words, second compartment 28 has opening 46 which selectively permits access to second enclosure 44 without necessarily requiring the opening of liquid dispensing opening 32. As a result, the product, article, prize, or object 24 contained within second compartment 28 does not directly contact liquid 22 contained within first compartment 26.

As explained above, second enclosure 44 preferably does not communicate directly with first enclosure 30. In the preferred embodiment of the present invention, second enclosure 44 communicates with an atmosphere 48 exterior to apparatus 20.

Within the preferred embodiment of the present invention, second compartment 28 comprises a pressed aluminum lid 50 having a generally tubular second sidewall 52 and a second floor 54. Second floor 54 is preferably formed integrally with second sidewall 52. Second sidewall 52 has a second upper edge 56 positioned at an opposed end 57 from second floor 54. Second upper edge 56 has a generally planar flange 58 extending radially therefrom. Planar flange 58 has an outer perimeter 60.

In essence, lid 50 of apparatus 20 is molded or punched out to form an integral second compartment 28. In other words, second compartment 28 comprises a separate container that his formed within lid 50 of apparatus 20. When lid 50 is placed upon and secured to a conventional beverage container, such as to first compartment 26, a portion of second compartment 28 projects or protrudes into a cavity formed within first enclosure 30 of first compartment 26. The resulting structure is an inwardly positioned second compartment 28 and a surrounding outwardly positioned first compartment 26 that are separated from one another.

Similar to first compartment 26, the portion of second compartment 28 that project or protrudes into first enclosure 30 is defined by second sidewall 52. Second sidewall 52 may take nearly any desirable shape or configuration and still accomplish the purposes of this invention. The inventor, however, prefers that second sidewall 52 be generally cylindrical or conical. By using second sidewall 52 with a slightly conical shape, a plurality of lids 50 may be stacked upon one another for more efficient shipping of component parts of apparatus 20. However, any tubular shape, albeit having a round, square, triangular, oval, or other cross-sectional appearance may similarly be used within the present invention.

If increased surface area contact between second sidewall 52 and liquid 22 is desired for the reasons stated above, second sidewall 52 may be provided with outwardly radiating thermal flanges, protrusion, or corrugations. Although this alternative embodiment is not currently illustrated within the drawings, it is encompassed and taught within the present description of the invention. It is not believed that such drawings are necessary for the understanding of the invention as taught herein.

Once first compartment 26 and second compartment 28 are manufactured, first compartment 26 is turned upright so that first enclosure 30 may contain liquid 22. Liquid 22 is then poured into first enclosure 30.

Once the liquid filling procedure is complete, outer perimeter 60 of planar flange 58 is joined to first upper edge 40 of first sidewall 36 to seal in and contain liquid 22. This procedure is usually accomplished by rolling outer perimeter 60 to first upper edge 40. Alternative, or in addition to such rolling, outer perimeter 60 may be welded and/or adhered to first upper edge 40.

Thus positioned, second compartment 28 further defines the boundaries of first compartment 26 and first enclosure 30.

Planar flange 58 is preferably provided with a breakable seal 62 that is positioned therein. Breakable seal 62 in fact defines liquid dispensing opening 32.

Apparatus 20 further comprises means 64 for rupturing or breaking seal 62. By rupturing or breaking seal 62, the consumer is permitted selective access to the contents of first enclosure 30.

Within the preferred embodiment of the present invention, rupturing or breaking means 64 comprises a pull tab 66. Pull tab 66 is pivotally secured to planar flange 58 by any appropriate means. However, the inventor prefers to pivotally secure pull tab 66 to planar flange 58 by means of a single rivet 68.

Although at first glance, pull tab 66 may appear similar to a conventional pull tab, pull tab 66 of the present invention is much larger and serves an additional purpose from that of a conventional pull tab. For example, pull tab 66 is capable of pivoting to at least partially obstruct or not obstruct opening 46 to second enclosure 44. Thus operated, the pivotal movement of pull tab 66 will permit selective access and removal or retention to the contents of second enclosure 44. Thus, a single pull tab 66 can be used to access the separate openings 32 and 46 both of first compartment 26 and of second compartment 28.

Opening 46 of second compartment 28 may be provided with a cap, lid, adhesive seal, or the like, to prevent (a) escape of the product, article, prize, or object 24 contained therein, (b) contamination or soiling of the product, article, prize, or object 24 contained therein and/or (c) tampering or theft of the product, article, prize, or object 24 contained therein.

Alternatively, or in addition to the cap, lid, adhesive seal, or the like, as previously mentioned, apparatus 20 may also be provided with a separate receptacle 70, tube, capsule, or the like, to contain the product, article, prize, or object 24. In essence, receptacle 70 simply houses the product, article, prize, or object 24. Receptacle 70 is then inserted, placed, pressed, or snapped into loose or tight engagement with second sidewall 52 of second compartment 28 which define second enclosure 44. If a separate receptacle 70 is used, a cap 72, lid, or seal can be secured to an open end 70' of receptacle 70 to secure the product, article, prize, or object 24 therein.

In addition to the aforementioned structure of apparatus 20, the present invention also includes a method for manufacturing apparatus 20 to contain liquid 22 and product, article, prize, or object 24. Such method comprises the steps of:

(a) forming first compartment 26 which defines first enclosure 30 within which liquid 22 may be contained or dispensed, first compartment 26 having an openable liquid dispensing opening 32 which selectively permits access to first enclosure 30, first compartment 26 being manufactured from a pressed aluminum container having a generally tubular first sidewall 36 and first floor 38 formed integrally with first sidewall 36, first sidewall 36 having first upper edge 40 positioned at opposed end 42 from first floor 38, first sidewall 36 being generally cylindrical;

(b) forming second compartment 28 defining second enclosure 44 within which product, article, prize, or object 24 may be removably contained, second compartment 28 being positioned internally within first compartment 26, second enclosure 44 not communicating with first enclosure 30, second compartment 28 having opening 46 which selectively permits access to second enclosure 44, second enclosure 44 communicating with atmosphere 48 exterior to apparatus 20 without necessarily requiring opening of liquid dispensing opening 32, second compartment 28 being manufactured from a pressed aluminum lid 50 having a generally tubular second sidewall 52 and second floor 54 formed integrally with second sidewall 52, second sidewall 52 having second upper edge 56 positioned at opposed end 57 from second floor 54, second upper edge 56 having a generally planar flange 58 extending radially therefrom, planar flange 58 having outer perimeter 60 thereof, second sidewall 52 being generally cylindrical or conical, planar flange 58 having breakable seal 62 positioned therein, breakable seal 62 defining openable liquid dispensing opening 32;

(c) placing liquid 22 within first enclosure 30;

(d) joining outer perimeter 60 of planar flange 58 to first upper edge 40 of first sidewall 36, second compartment 28 further defining first compartment 26; and (e) placing product, article, prize, or object 24 within second enclosure 44.

The aforementioned method may be further restricted by requiring that the additional step of forming means 64 for rupturing or breaking seal 62 thereby permitting selective access to first enclosure 30, rupturing or breaking means 64 being a pull tab 66.

Another step requires the pivotally securing of pull tab 66 to planar flange 58.

Another step requires the pivoting of pull tab 66 to at least partially obstruct opening 46 to second enclosure 44 and thereby restrict access second enclosure 44.

Another step requires the pivoting of pull tab 66 not to obstruct opening to second enclosure 44 and thereby permit access to second enclosure 44.

Another step requires the pulling of pull tab 66 to rupture or break seal 62 thereby permitting access to first enclosure 30.

The means and construction disclosed herein are by way of example and comprise primarily the preferred forms of putting the invention into effect. Although the drawings depict preferred embodiment of the present invention, other embodiments have been described within the preceding text. One skilled in the art will appreciate that the disclosed device may have a wide variety of shapes and configurations. Additionally, persons skilled in the art to which the invention pertains might consider the foregoing teachings in making various modifications, other embodiments, and alternative forms of the invention.

It is, therefore, to be understood that the invention is not limited to the particular embodiments or specific features shown herein. To the contrary, the inventor claims the invention in all of its forms, including all alternatives, modifications, equivalents, and alternative embodiments which fall within the legitimate and valid scope of the appended claims, appropriately interpreted under the Doctrine of Equivalents.

INDUSTRIAL APPLICABILITY

The present invention may be used within most industries wherein a readily dispensable liquid must be contained. Furthermore, the present invention has a special benefit in allowing its use with a wide variety of different liuid products. For example, the present invention may be used within the automotive industry to contain motor oil, petroleum, hydraulic fluid, brake fluid, and the like. The present invention may be used within the paint and furniture refinishing industries to contain paints, lacquers, thinners, stains, oils, varnishes, and other the like. Similarly, the present invention may be used within the cleaning industry to contain liquid soaps, stripping compounds, and the like. However, it is preferred that the present invention be used within the beverage industry to contain soda beverages, fermented beverages, and the like. In essence, the present invention may be used wherever simple, reliable, easily used apparatus and methods are needed to contain and dispense a liquid, and to present the consumer with a secondary product, article, prize, or object.

The apparatus of this invention is compact, unobtrusive, efficient, durable, rugged, is easily constructed, and is inexpensive and economical to manufacture.

Traditional or nontraditional manufacturing apparatus may be used to manufacture the present invention without significant alteration to accomplish the purposes taught herein.

If desired, the preferred embodiment of this invention may utilize preexisting beverage packaging machinery.

Once manufactured, the apparatus of the present invention can be easily transported and displayed without necessarily increasing the packaging size, transportation costs, or the available refrigeration space for display to the consumer.

I claim:

1. An apparatus for containing a removable liquid and a removable product, article, prize or object, said apparatus comprising:

a first compartment defining a first enclosure within which the liquid may be contained or dispensed, said first compartment having an openable liquid dispensing opening which selectively permits access to said first enclosure;

a second compartment defining a second enclosure within which the product, article, prize or object may be removably contained, said second compartment being positioned internally within said first compartment, said second enclosure not communicating with said first enclosure, said second compartment having an opening which selectively permits access into said second enclosure, wherein said second enclosure may have unobstructed communication with an atmosphere exterior to said apparatus without necessarily requiring opening of said liquid dispensing opening, said first compartment comprising a pressed aluminum container having a generally tubular first sidewall and a first floor formed integrally with said first sidewall, said first sidewall having a first upper edge positioned at an opposed end from said first floor, said second compartment comprising a pressed aluminum lid having a generally tubular second sidewall and a second floor formed integrally with said second sidewall, said second sidewall having a second upper edge positioned at an opposed end from said second floor, said second edge having a generally planar flange extending radially therefrom, said planar flange having an outer perimeter thereof, said outer perimeter of said planar flange being joined to said first upper edge of said first sidewall, said second compartment further defining said first compartment, said planar flange having a breakable seal positioned therein, said breakable seal defining said openable liquid dispensing opening; and (c) means for rupturing or breaking said seal thereby permitting selective access to said first enclosure, said rupturing or breaking means comprising a pull tab, said pull tab being pivotally secured to said planar flange, said pull tab being capable of pivoting between positions that at least partially obstruct and not obstruct said opening to said second enclosure, movement of said pull tab thereby permitting selective access into said second enclosure.

2. The apparatus of claim 1, wherein said first sidewall is generally cylindrical.

3. The apparatus of claim 1, wherein said second sidewall is generally cylindrical or conical.

4. The apparatus of claim 1, further comprising a liquid contained within said first enclosure, said liquid comprising a carbonized soda drink, a carbonated soda drink, or a fermented beverage.

5. The apparatus of claim 1, further comprising a liquid contained within said first enclosure, said liquid comprising a noncarbonated drink, motor oil, a petroleum product, hydraulic fluid, brake fluid, paint, lacquer, thinner, stain, oil, varnish, liquid soap, or a stripping compound.

6. The apparatus of claim 4, wherein said liquid is contained within said apparatus at a pressure exceeding one Atmosphere.

* * * * *